US007496986B2

(12) United States Patent
Jones

(10) Patent No.: US 7,496,986 B2
(45) Date of Patent: Mar. 3, 2009

(54) BARBER HAIR OR HAIR STYLIST CLEAN UP HAIR BROOM

(76) Inventor: Ronald Jones, 35 S. Grand St., Burns, OR (US) 97720

( * ) Notice: Subject to any disclaimer, the term of this patent is extended or adjusted under 35 U.S.C. 154(b) by 0 days.

(21) Appl. No.: 11/550,470

(22) Filed: Oct. 18, 2006

(65) Prior Publication Data

US 2007/0107157 A1 May 17, 2007

Related U.S. Application Data

(60) Provisional application No. 60/727,761, filed on Oct. 18, 2005.

(51) Int. Cl.
*A46B 15/00* (2006.01)
*A47C 7/62* (2006.01)

(52) U.S. Cl. ..... 15/246; 297/217.1; 297/463.2

(58) Field of Classification Search ..... 15/1, 15/30, 34, 36, 237, 246, 258; 297/188.01, 297/217.1, 463.1, 463.2
See application file for complete search history.

(56) References Cited

U.S. PATENT DOCUMENTS 1,828,820 A * 10/1931 Schulse ..... 15/23
2,498,004 A * 2/1950 Pullen ..... 297/344.24
2,634,801 A * 4/1953 Strok ..... 312/235.7
3,994,528 A * 11/1976 Humphrey ..... 297/182
4,109,338 A 8/1978 Mertes
4,914,773 A 4/1990 Ham
5,018,944 A * 5/1991 Bielecki et al. ..... 416/146 R
5,161,772 A 11/1992 DiResta
5,232,347 A * 8/1993 VonBergen ..... 416/244 R
5,359,751 A * 11/1994 Bellardini ..... 15/394
5,414,889 A 5/1995 Sartori
5,437,078 A 8/1995 Courcelles
5,440,782 A 8/1995 Yamashita
5,651,558 A * 7/1997 Boyce ..... 280/304.1
6,154,922 A 12/2000 Vanderlinden
6,782,579 B1 * 8/2004 Grimm ..... 15/246
2006/0218743 A1 * 10/2006 Riske ..... 15/346

* cited by examiner

*Primary Examiner*—Randall Chin

(57) ABSTRACT

An apparatus for cleaning clipped hair proximate to the chair of a barber or stylist comprising a pivotable brush attached to the bottom of the chair, said brush having a retracted and extended position; said extended position extending parallel to the floor such that the brush rotates 360 degrees and cleans hair that has fallen on the floor.

1 Claim, 9 Drawing Sheets

BARBER HAIR OR HAIR STYLIST CLEAN UP HAIR BROOM

CROSS REFERENCE TO RELATED APPLICATIONS

This application claims benefit to provisional application 60/727,761, filed on Oct. 18, 2005, entitled "BARBER OR HAIR STYLIST CLEAN UP HAIR BROOM", which is incorporated by reference herein in its entirety.

FIELD OF THE INVENTION

The present invention is directed toward the field of brooms. In particular, the present invention discloses a folding broom which attaches to the back of a rotating swivel chair for sweeping up hair and the like.

BACKGROUND OF THE INVENTION

Falling hair at barbershops, beauty shops and the like creates both a health and safety issue. Historically, there have been a number of patents directed toward the field of brooms. U.S. Pat. No. 4,109,338 discloses a sweeping broom of the type having a brush or head attached to a handle and is combined with a flexible dustpan that is slidable along the broom handle and has a shape conforming to the curvature of the brush. When engaged on the broom handle, the dustpan can be positioned against the rear face of the brush to serve as a backing member for adjustably regulating the stiffness of the bristles and rendering the broom adaptable for indoor and outdoor use. When removed from the broom, the flexible dustpan can be pressed flat against a floor or other sweeping surface for use with the broom in the normal manner.

U.S. Pat. No. 4,914,773 discloses an improved cleaning apparatus for use in cleaning the floor, which comprises a first belt as a broom, a second as a mop and a trash containing corner, whereby as the cleaning apparatus is pushed and the wheels, the conveyor belt and wiping belt are driven so as to perform the functions of sweeping, wiping, and effectively protecting the trash from dropping therefrom.

U.S. Pat. No. 5,161,772 discloses a stand adapted to be attached to a longhandled implement, such as a push broom, a mop, a rake, a floor squeegee and the like for holding an implement when it is not being used on a supporting surface, with the handle in a substantial vertical position whereby it can be quickly grasped for use of the same. The stand includes a leg which may be mounted on the implement handle or on the front end of a part of the body of the implement. The stand leg may be integrally formed with a part of the body of the implement. The stand leg may be adjustably mounted on the implement handle.

U.S. Pat. No. 5,414,889 discloses a versatile broom, brush, or similar floor care implement comprising a head anchoring on a first side thereof, a multiplicity of bristles presenting a substantially flat bristle surface, and an integrally formed connector mating structure on an opposed second side of the head. The cleaning implement is maneuvered by an elongated handle and is disposed at a variety of pre-selected angles. Intermediate, the head and handle is a handle interconnector to which the handle is detachably secured at one extremity and a connection assembly is ratchetably-pivotably secured at the other extremity. The connection assembly and the integrally formed connector mating structure on the head interact so that the handle can be selectively pivoted in a single plane as much as 180 degrees or more and locked at any of a number of pre-selected angles relative to the substantially flat bristle end surface.

U.S. Pat. No. 5,437,078 discloses a dust pan adapted to be used with a vacuum which allows for collected dust to be drawn up by the vacuum. The dust pan of the present invention comprises a bottom wall and side walls defining a pan unit. The bottom wall downwardly extends to a substantial evenly rest on a floor surface. The dust pan further comprises tubular means adapted to be engaged with a vacuum source. The tubular means are connected at the rear of the pan unit and are in communication with the interior of the pan. The dust pan can optionally include a spring clip for a releasable attachment to a broom stem portion.

U.S. Pat. No. 5,440,782 discloses a vacuum cleaner suction nozzle attachment which permits a user to utilize a vacuum cleaner in the fashion of a broom, namely which is capable of vacuuming dust while sweeping dust out of a narrow space or out of a corner portion of a wooden or Tatami floor. The suction nozzle attachment includes a joint pipe which is connectible to a suction pipe of a vacuum cleaner. The joint pipe has its fore end pivotally connected to an apex portion of a brush holder box of a flattened box-like shape for adjustments of the joint pipe angle relative to the brush holder box. The brush is mounted in an intake opening at the bottom of the brush holder box so that the suction nozzle attachment presents a broom-like shape as a whole.

U.S. Pat. No. 6,154,922 discloses a self-propelled factory floor cleaning vehicle which has a cylindrically-shaped rotating sweeping broom to propel forwardly debris disposed on a contacted portion of a factory floor being cleaned, thereby creating a forwardly propelled stream of debris. A hopper is disposed to receive and retain the forwardly propelled stream of debris. A deflector flap is disposed forwardly of the rotating sweeping broom and immediately rearwardly of the hopper to receive at least a portion of the forwardly propelled stream of debris to deflect it upwardly and forwardly onto the hopper. An air blast outlet effects a blast of air forcefully by impinging in a forward direction the floor behind the leading edge of the broom. This thereby propels forwardly fine debris disposed on the factory floor and further carries the debris forwardly through the sweeping broom. It than egresses it to deflect forwardly and upwardly off the deflector flap and forwardly past the deflector flap to travel to the hopper in a path having a forward component along its entire length, exclusive of subsequent impingement of the factory floor and exclusive of subsequent re-entry into the lower portion of the rotating sweeping broom.

While there have been a number of brooms and cleaning devices, none have addressed the unique problems associated with cleaning barber or beauty salon hair.

It is an object of the present invention to provide a novel barber chair hair broom and clean up system.

It is a further object of the present invention to provide a system for cleaning up barber or hair stylist hair cuttings or clippings.

It is a yet a further object of the present invention to provide a novel broom with a hair cleaning system which can be utilized.

SUMMARY OF THE INVENTION

Therefore, it is an object of the present invention to provide an apparatus for cleaning clipped hair proximate to the chair of a barber or stylist comprising a pivotable brush attached to the bottom of the chair, said brush having a retracted and extended position; said extended position extending parallel to the floor such that the brush rotates 360 degrees and cleans all hair on the floor.

It is a further object of the present invention to provide an apparatus for cleaning clipped hair on the floor proximate to a barber or beauty chair and a brush rotatably connected to the base of a chair and having its bristles touching the floor, said brush being rotatable a full 360 degrees.

It is still a further object of the present invention to provide an apparatus for cleaning clipped hair proximate to the rotating chair of a barber or hair stylist comprising an arm rotatably connected to the base of that chair and extending substantially vertically downward and a brush pivotally connected to the arm such that in a forward position the brush is attached to the back of the chair and in a downward position the brush extends diagonal to the floor such that the broom can rotate 360 degrees and clean the floor proximate to the chair.

DETAILED DESCRIPTION OF THE INVENTION

Figure 1:
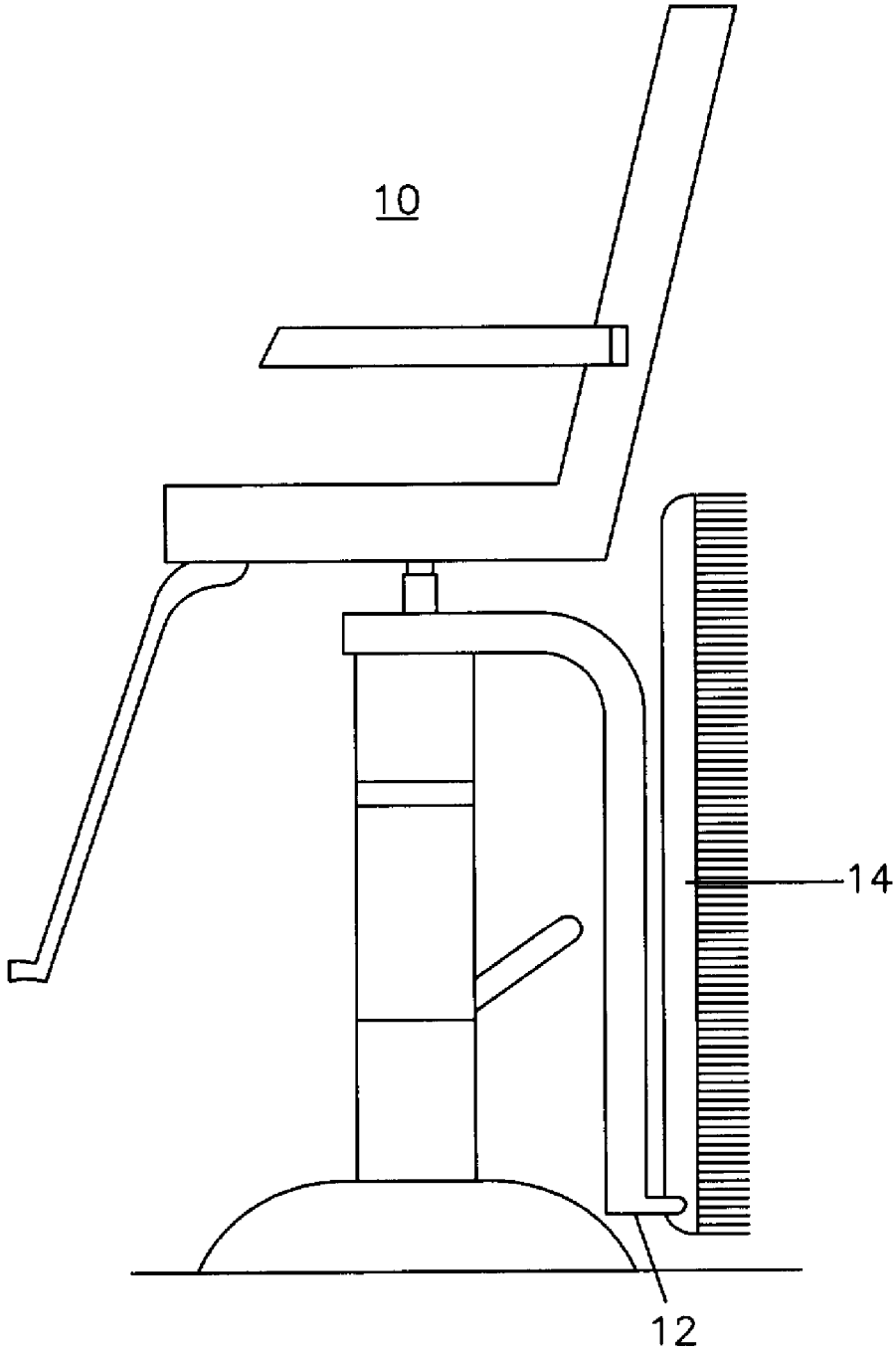
FIG. 1 is a side perspective view of a first embodiment of the invention.
Figure 1A:
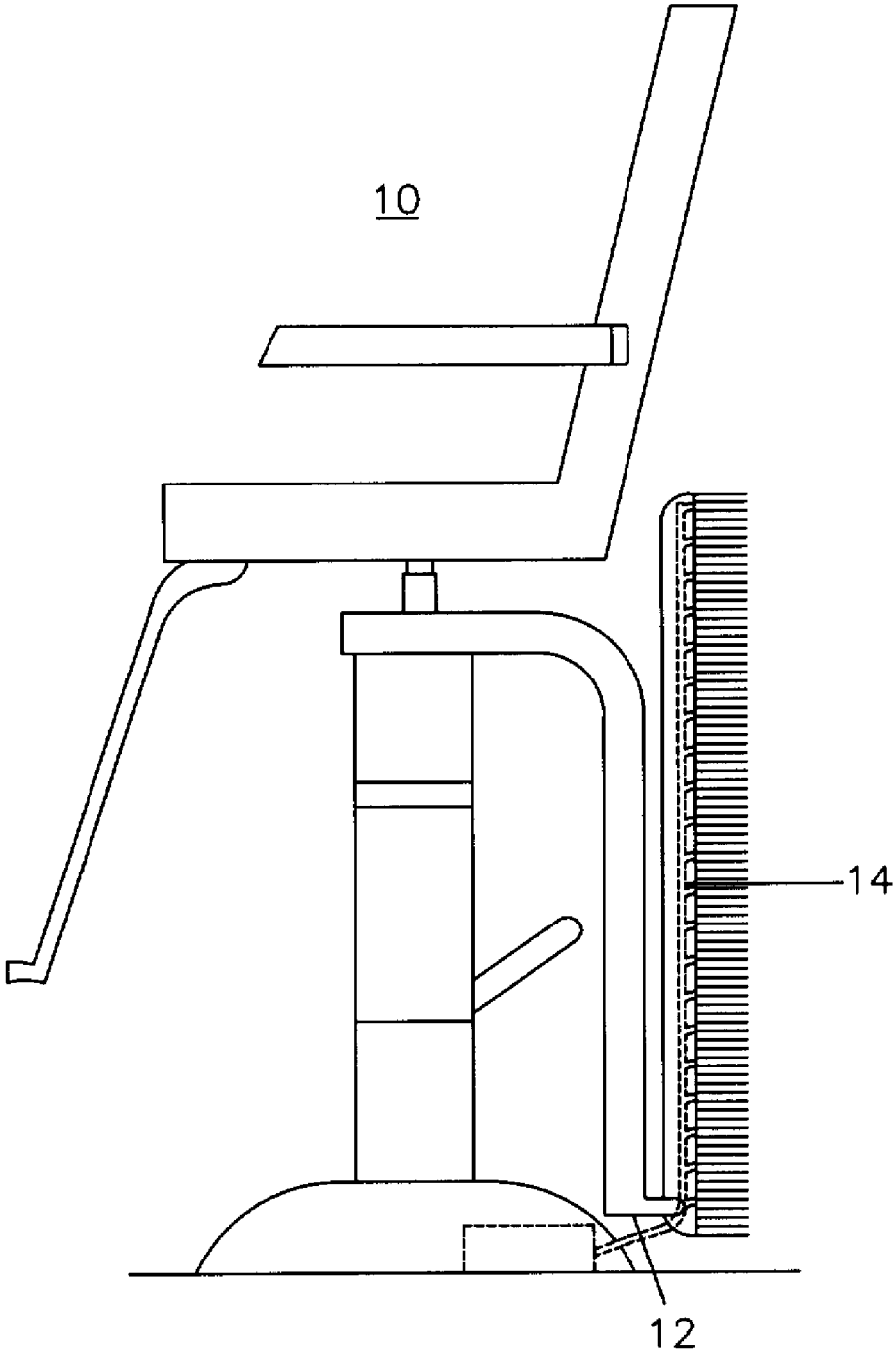
FIG. 1*a* is a side perspective view of an alternative embodiment of the invention.
Figure 2:
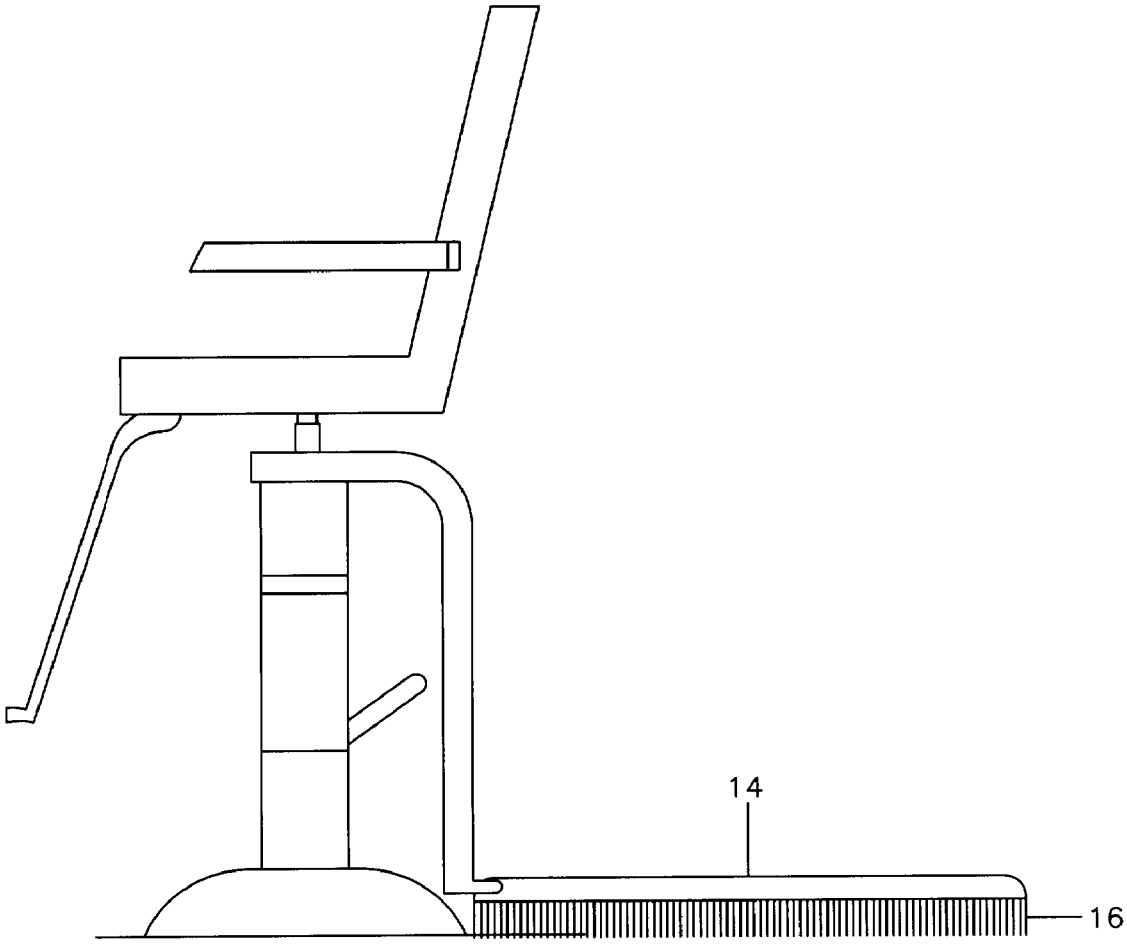
FIG. 2 is a side perspective view of the present invention in operation.
Figure 2A:
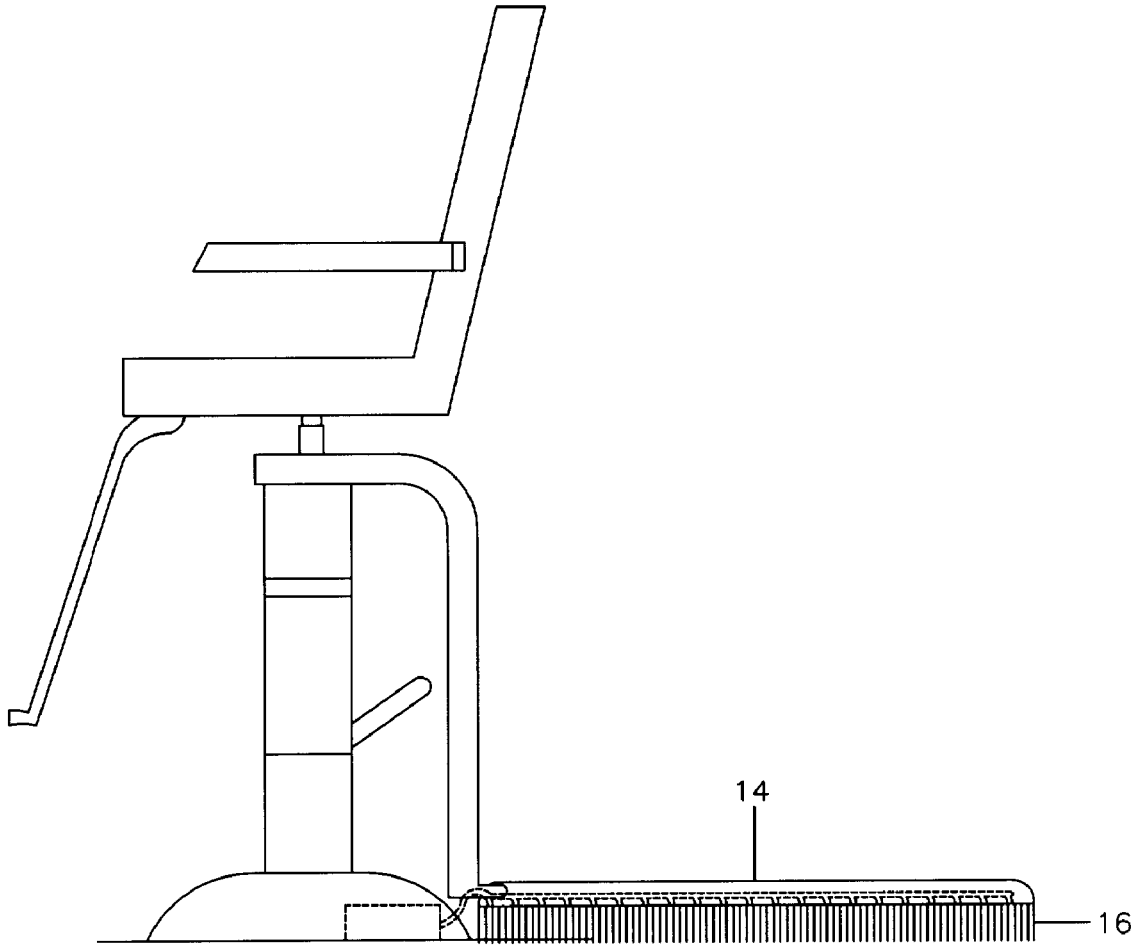
FIG. 2*a* is a side perspective view of the alternative embodiment in operation.

The present invention is described with reference to the enclosed Figures, wherein the same numbers are used where applicable. The present invention, in a broad embodiment, comprises a barber or beauty chair 10, which is combined with a retractable hair broom 12 that rotates a full 360 degrees to sweep up hair on the floor. As shown in FIGS. 1 and 2, the brush 16 in one embodiment is pivotable 90 degrees. In the preferred embodiment, the brush 16 is pivotably attached to a support arm 14 which extends vertically downward from the chair 10.

Figure 1B:
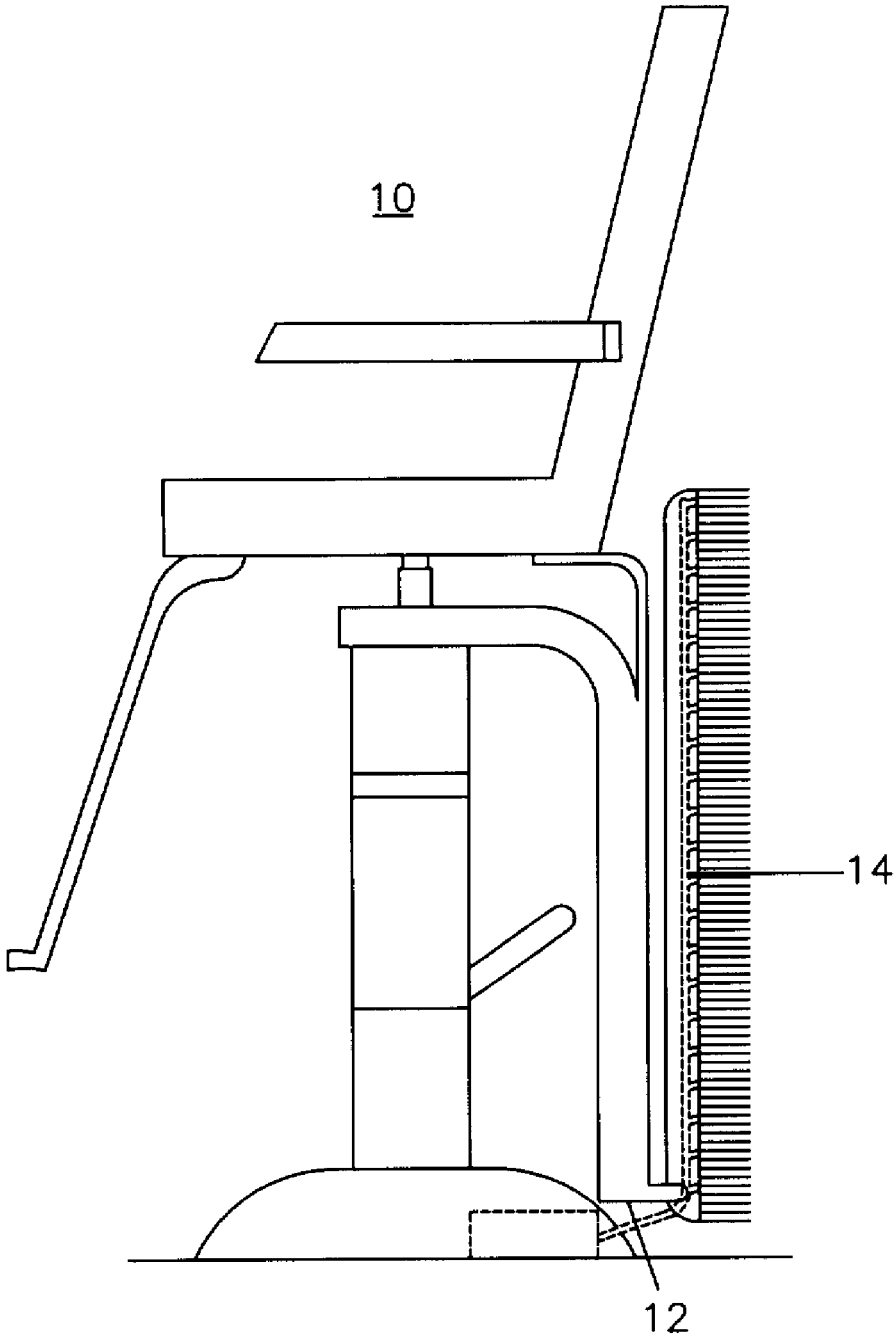
FIG. 1*b* is a side perspective view of an alternative embodiment where the brush is attached to the bottom of the chair.
Figure 3:
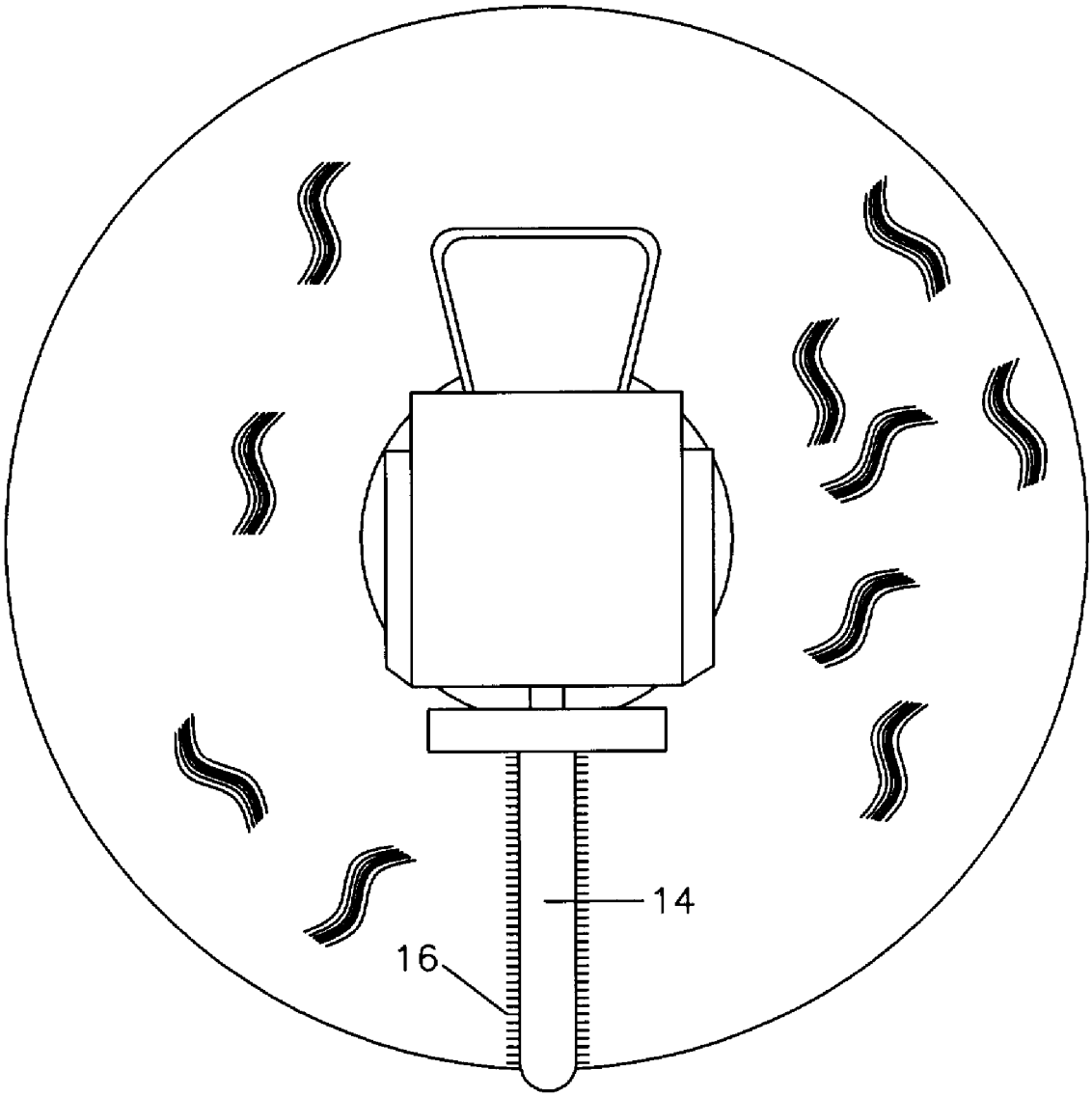
FIGS. 3 and 3*a* are overhead views of the present invention in operation.
Figure 3A:
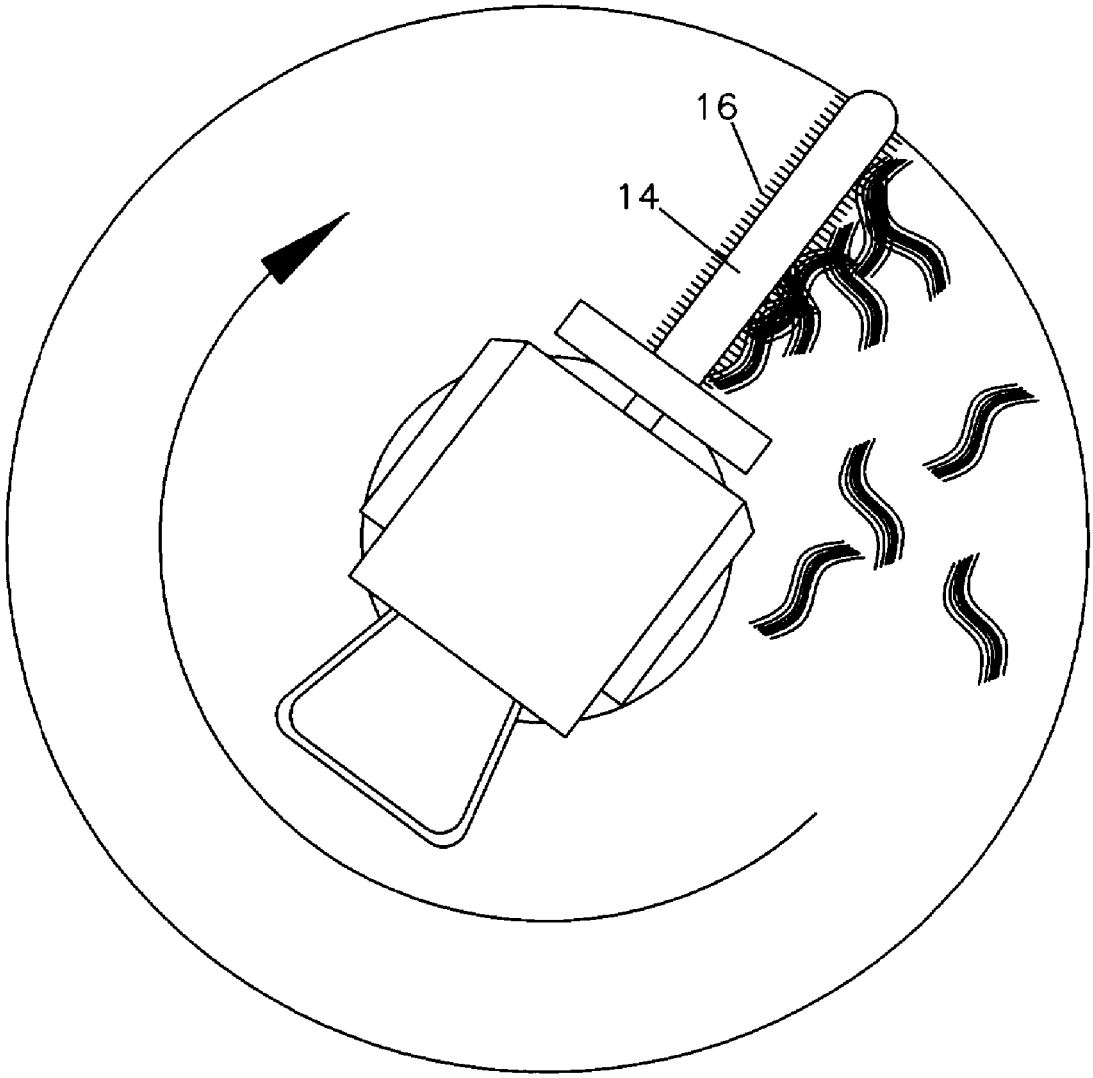
Figure 3B:
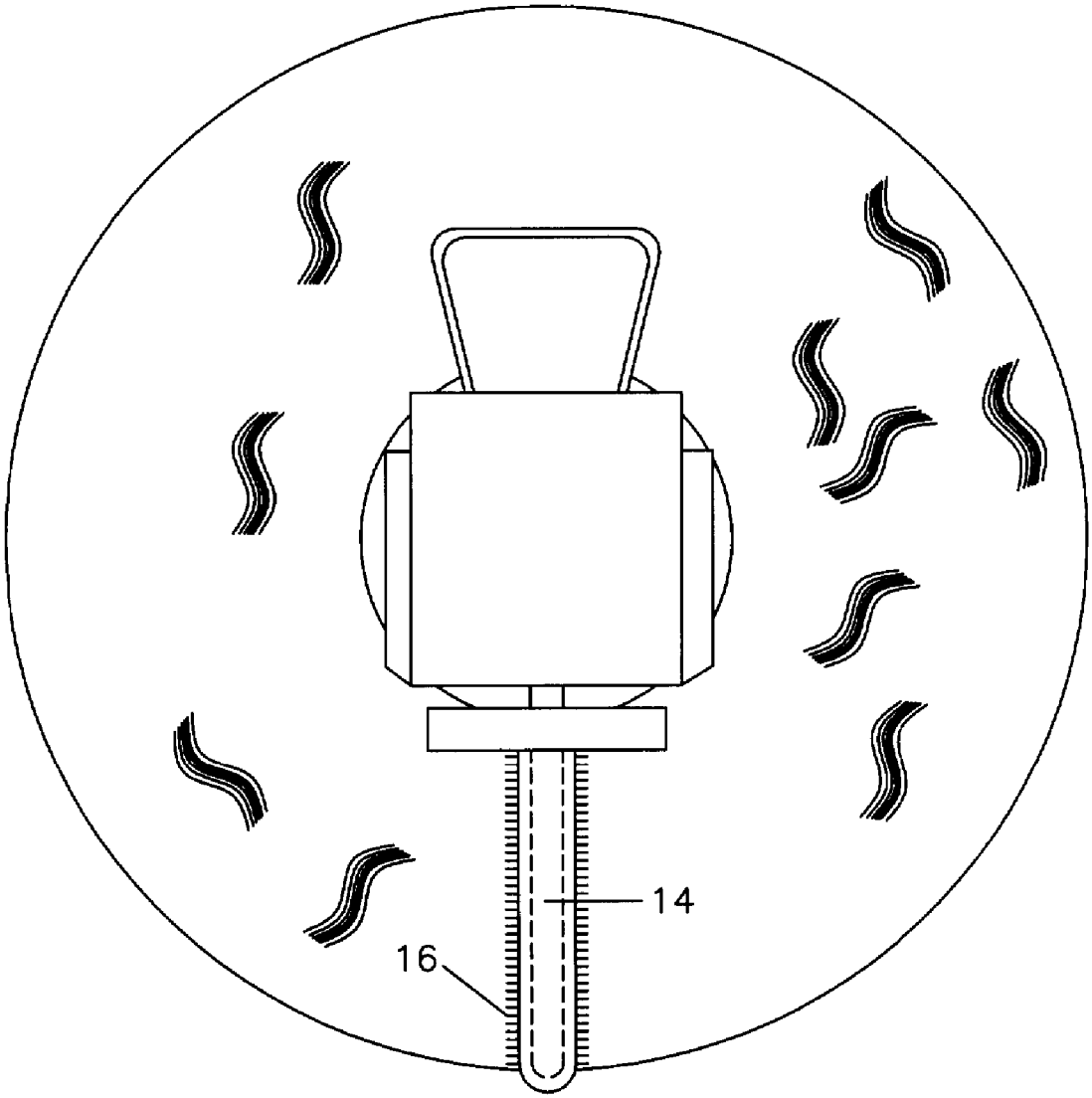
FIGS. 3*b* and 3*c* are overhead views of the alternative embodiment in operation.
Figure 3C:
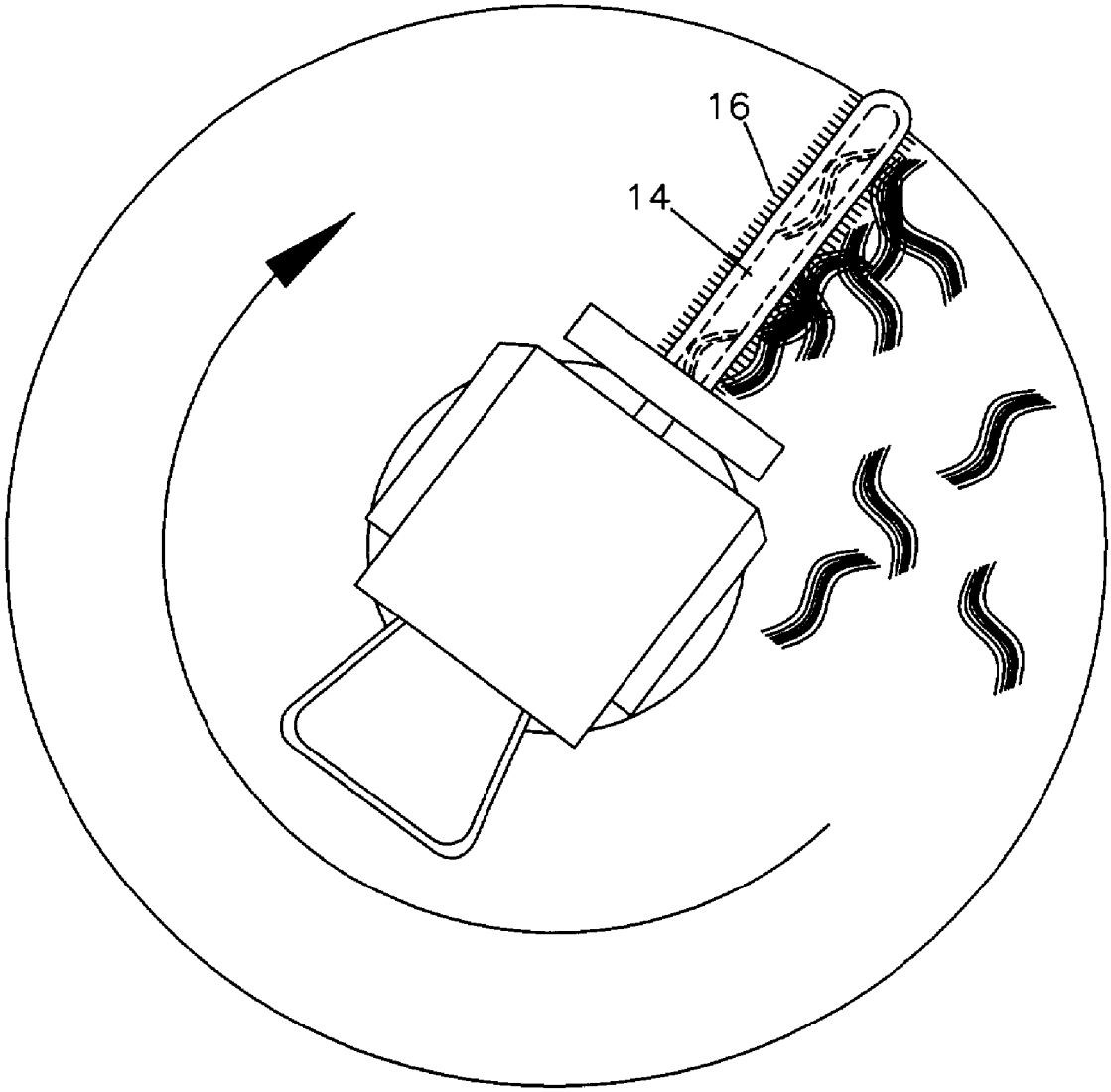

In operation, the chair 10 is rotated 360 degrees to clean up hair that has fallen to the ground, as shown in FIGS. 3 and 3*a*. As shown in FIG. 1*b*, the brush 16 can be attached to the bottom of the chair 10 to move pivotally upward and downward. When not in use, the brush 16 is placed in the upward position as shown in FIG. 1.

In a more preferred embodiment, as shown in FIGS. 1*a*, 2*a*, 3*b* and 3*c*, the invention includes a vacuum cleaner system 18 which is attached to the base of the chair 10 and which is coupled to the brush 16. As the chair 10 rotates and the vacuum 18, in conjunction with the brush 16, vacuums up the hair and removes it from the floor.

The present invention has been described with reference to the above-discussed preferred embodiments. It is to be appreciated that the true nature and scope of the present invention is to be determined with reference to the claims appended hereto.

I claim:

1. An apparatus for cleaning clipped hair proximate to a rotating chair of a barber or hair stylist comprising: a rotating chair having a base, an arm rotatably connected to said base of said rotating chair and extending substantially vertically downward; and a brush pivotally connected to said rotatably connected arm such that in an upward position said brush is attached to the back of said rotating chair and in a downward position the brush extends parallel to aid floor, such that said brush can rotate 360 degrees and clean the floor proximate to the said rotating chair.

* * * * *